United States Patent [19]

Hamil et al.

[11] Patent Number: 4,731,096

[45] Date of Patent: Mar. 15, 1988

[54] HYDROCARBON COMPOSITIONS OF HIGH ELONGATIONAL VISCOSITY AND PROCESS FOR MAKING THE SAME

[75] Inventors: Henry F. Hamil, New Braunfels; William D. Weatherford, Jr.; George E. Fodor, both of San Antonio, all of Tex.

[73] Assignee: Southwest Research Institute, San Antonio, Tex.

[21] Appl. No.: 854,104

[22] Filed: Apr. 21, 1986

[51] Int. Cl.[4] ..... C10L 1/14

[52] U.S. Cl. ..... 44/62

[58] Field of Search ..... 44/62

[56] References Cited

U.S. PATENT DOCUMENTS

| | | | |
|---|---|---|---|
| 2,807,597 | 9/1957 | Sonnenfeld et al. | 260/29.7 |
| 2,921,043 | 1/1960 | Uraneck | 260/45.5 |
| 3,091,604 | 5/1963 | Lukens | 260/87.3 |
| 3,395,134 | 7/1968 | D'Aleilo | 260/89.5 |
| 3,467,604 | 9/1969 | Michaels | 260/2.5 |
| 3,574,575 | 4/1971 | Gee et al. | 44/62 |
| 3,579,613 | 5/1971 | Schaper et al. | 260/901 |
| 3,658,492 | 4/1972 | Messina | 44/62 |
| 3,812,034 | 5/1974 | Gaydasch | 44/62 |
| 3,920,605 | 11/1975 | Sato et al. | 260/42.17 |
| 4,205,143 | 5/1980 | Goodman | 525/213 |
| 4,288,511 | 9/1981 | Myers et al. | 430/17 |
| 4,334,891 | 6/1982 | Brooks et al. | 44/62 |

*Primary Examiner*—William R. Dixon, Jr.
*Assistant Examiner*—Margaret B. Medley
*Attorney, Agent, or Firm*—Sigalos & Levine

[57] ABSTRACT

The present invention comprises a hydrocarbon composition consisting essentially of a hydrocarbon and an ionic-association or coordination-complex polymer in an amount sufficient to increase and maintain the elongational viscosity of said composition at a level greater than that of said hydrocarbon alone; said polymer capable of disassociation upon application of a high shear to said composition and reassociation upon withdrawal of a high shear, and to the process for improving the elongational viscosity of hydrocarbons subjected to a high shear regime comprising adding to said hydrocarbon an ionic-association or coordination-complex polymer in amount sufficient to increase the elongational viscosity of said hydrocarbon.

8 Claims, No Drawings

HYDROCARBON COMPOSITIONS OF HIGH ELONGATIONAL VISCOSITY AND PROCESS FOR MAKING THE SAME

BACKGROUND OF THE INVENTION

This invention was made with Government support under Contract No. DAAK70-82-C-0001 awarded by the U.S. Army. The Government has certain rights in this invention.

The present invention relates to modification of the rheology of hydrocarbon materials in order to impart thereto reduced drag, antimist properties, and other desired modifications making such materials easier to pump and/or handle, and the like.

At the present time, high polymers, such as polydecene-1 are used as rheology modifiers in such hydrocarbon materials. While such modifiers are initially successful in that they do impart the desired rheology modification, there has been noted a major problem with the effectiveness of such polymers when the hydrocarbon material is subjected to a high shear regime. Examples of such high shear regimes are in the pumps in pipelines carrying hydrocarbon streams or through the fuel injector or fuel pump of an engine to ignite the hydrocarbon fuel. The polymers in question, such as the polydecene-1 are degraded or depolymerized and the resulting decrease in the molecular weight of the high polymers results in a decrease and, in some cases, a loss of the desired rheological properties.

Attempts to overcome this breakdown in the effectiveness of the high polymers have not been successful and as a consequence there has been no successful anti-drag or anti-mist additive for hydrocarbon streams such as hydrocarbon fuels, for example, or products which are to be pumped into pipelines over long distances and the pumping cost is high due to the drag on the pumped hydrocarbon stream.

SUMMARY OF THE INVENTION

A novel composition and process have now been found which do overcome the deficiencies of the prior art and can successfully modify the rheology of hydrocarbon materials to reduce the drag on the pumped hydrocarbon streams, impart anti-mist properties to hydrocarbon fluids, and generally increase the elongational viscosity of the hydrocarbon material and maintain it at a specified level despite the hydrocarbon material being subjected to high shear forces.

Briefly, the present invention comprises a hydrocarbon composition consisting essentially of a hydrocarbon and an ionic-association or coordination-complex polymer in an amount sufficient to increase and maintain the elongational viscosity of said composition at a level greater than that of said hydrocarbon alone and to the process for improving the elongational viscosity of hydrocarbons subjected to a high shear regime comprising adding to said hydrocarbon an ionic-association or coordination-complex polymer in amount sufficient to increase the elongational viscosity of said hydrocarbon.

DETAILED DESCRIPTION

As to the hydrocarbon material that is a part of the composition, it can be any hydrocarbon which needs to have its rheology modified to reduce drag, impart anti-mist properties, or otherwise overcome problems based on the low elongational viscosity of the hydrocarbon stream. Examples of such materials which require reduced drag are hydrocarbons, hydrocarbon mixtures and other organic liquids which are pumped great distances through pipelines where pumping energy loss due to drag occurs.

For anti-misting properties, the material used is a hydrocarbon fuel such as gasoline, kerosene, diesel fuel, jet fuel, and the like. The anti-misting property is important in impact or crash situations when a fuel tank is ruptured since addition of the polymers disclosed herein to form the present compositions will act to prevent any significant atomization of the fuel due to impact and thereby prevents formation of a large fuel mist fireball if the fuel ignites.

The other essential component of the composition is an ionic-association polymer or coordination-complex polymer which would not only increase the elongational viscosity of the hydrocarbon stream but which, if exposed to high shear to the extent that it is degraded or broken up, it would only do so at the ionic or complexation linkages and will reform rapidly upon removal of the high shear condition.

Basically, the ionic-association polymers are combinations of acidic polymers with basic polymers which associate in a non-polar medium. Examples of acidic polymers are polymers of styrene with a very low proportion of acrylic acid, preferably about 1%; although levels of about 3% to 4% can be utilized. The basic polymer of the association polymer can be a copolymer of styrene with up to about four; preferably one, weight percent of vinyl benzyl chloride; the molecular weight of the polymer preferably being less than about 10,000. Such polymer is then reacted with dimethylamine to give a basic polymer. The two polymers are then associated in a non-polar medium to give a high molecular weight and viscous ionic-association polymer which can be added to hydrocarbons to increase the elongational viscosity and thereby reduce drag, misting, and the like.

Examples of other suitable acidic polymers that can be used to form ionic-association polymers are those based on polybutadiene, polybutene, polypropylene, and the like copolymers of the olefinic or diolefinic hydrocarbon monomers; all of such polymers containing the noted levels of carboxylic acid or sulfonic acid groups.

Examples of other basic polymers that can be utilized to form such ionic-association polymers are those based on the polymer systems described above with the exception that they contain primary, secondary, or tertiary amine groups instead of the acidic groups.

In all the examples of these polymers, the preferred way of forming the ionic-association polymer is to make separate solutions, preferably 5% weight solutions in a hydrocarbon solvent, to produce a low viscosity acidic polymer solution and a low viscosity basic polymer solution. Equal portions of each of these two low viscosity solutions are admixed and the resulting mixture rapidly increases in viscosity as the polymers associate. Such high molecular weight and high viscosity polymer is then added to the hydrocarbon material, preferably in an amount about 5% by weight to give the desired elongational viscosity; although, for any given hydrocarbon material and any particular ionic-association polymer, that ratio may have to be adjusted in order to get the optimum rheological properties desired.

In addition to the ionic-association polymers, one can utilize coordination-complex polymers such as those obtained by having polymers containing the iminiodiacetic acid group which will complex in the presence of divalent metals such as copper, cobalt, chromium, nickel and the like. Examples of other suitable groups useful in forming these coordination complexes are the 1,3 diketo groups; such as acetylacetone, bis-oximes of 1,3 diketo groups, aromatic m-hydroxy aldehyde groups, and 1,2 or 1,3 diaminoalkyl groups.

Here again, these coordination complexes are used in the same levels with the hydrocarbon materials; namely, about 5% by weight.

While larger proportions of the polymers can be added, it is uneconomic to do so.

Both the ionic-associated polymers and the coordination-complexes when subjected to high stress tend to "break up" at the ionic or complexation linkage, as the case may be, but once the high shear condition is removed these association polymers, whether ionic or complexation, rapidly reform to give the elongational viscosity necessary to give the desired rheological properties on the hydrocarbon material.

The invention will be further described in connection with the following examples which are set forth for purposes of illustration only.

EXAMPLE 1

A first low molecular weight polystyrene copolymer (approx. 8,000–10,000 mw) was prepared by polymerizing styrene and acrylic acid about 1 wt. %). This copolymer in amount of 0.5 wt. % was dissolved in a portion of unleaded gasoline to form a first unleaded gasoline solution.

A second low molecular weight polystyrene copolymer (approx. 8,000–10,000 mw) was prepared by polymerizing styrene with 1 wt. % vinyl benzyl chloride and reacting the polymer with dimethylamine. This copolymer in an amount of 0.5 wt. % was dissolved in a further portion of the same unleaded gasoline to form a second unleaded gasoline solution.

The elongational viscosity of each of these two solutions was essentially unchanged as compared to the elongational viscosity of the original unleaded gasoline.

Upon mixing equal volumes of the two solutions, an ionic-association polymer formed and an immediate increase in elongational viscosity was obtained. The resultant mixture had a thickened, syrupy consistency.

When subjected to high shear, as by vigorous agitation, this viscosity was immediately reduced to approximately that of the original unleaded gasoline. Removal of the shear forces led to an immediate increase in viscosity to the former thickened, syrupy consistency.

With the increased viscosity, the unleaded gasoline mixture also did not mist.

EXAMPLE 2

The procedure of Example 1 is followed except that an equal amount of crude oil is substituted for the unleaded gasoline in forming the two solutions.

The mixture of the two solutions has an increased elongation viscosity and desired rheological properties. Application of high shear to the mixture reduces this viscosity and rheological properties to essentially that of the crude oil alone with the increased viscosity and rheological properties of the mixture returning when the shear force is removed.

With the crude oil mixture the elongational viscosity increase modifies the rheological properties so that as the mixture moves through a pipeline, for example, there is reduced turbulence in the boundary layer and hence reduced drag. Loss of the viscosity increase and the resultant rheological properties occurs only when high shear is applied, as in the pipeline pumps, but immediately return after the mixture passes through the pumps.

EXAMPLE 3

A modified unleaded gasoline is formed as in Example 1, except that the following coordination complex-polymer is substituted for the ionic-association polymer used therein.

This coordination-complex polymer is prepared by first polymerizing styrene with 1 wt. % vinyl benzyl chloride followed by reacting the resultant copolymer with an amount of iminodiacetic acid sufficient to react with all the chloride groups in the copolymer.

This copolymer in an amount of 0.5 wt. % is then dissolved in the unleaded gasoline to form a solution to which is added a stoichiometric amount of copper napthenate to cause complexation of the copper and imino diacetic acid groups to form a coordination-complex polymer in solution in the unleaded gasoline.

The resultant polymer-gasoline mixture has an increased elongational viscosity and the improved rheological properties, as anti-misting.

EXAMPLE 4

The procedure of Example 2 is followed except that the coordination-complex polymer of Example 3 is substituted for the ionic-disassociation polymer used therein.

Equivalent results as to increased elongational viscosity and anti-drag properties are present in the resultant polymer-crude oil mixture.

While the invention has been described in connection with a preferred embodiment, it is not intended to limit the scope of the invention to the particular, form set forth, but, on the contrary, it is intended to cover such alternatives, modifications, and equivalents as may be included within the spirit and scope of the invention as defined by the appended claims.

What is claimed is:

1. A hydrocarbon composition consisting essentially of a hydrocarbon liquid and an ionic-association or coordination-complex polymer in an amount sufficient to increase and maintain the elongational viscosity of said composition at a level greater than that of said hydrocarbon alone; said polymer capable of dissociation upon application of the high shear regime to which said hydrocarbon is subjected, and reassociation upon withdrawal of the high shear.

2. The composition of claim 1, wherein said hydrocarbon is selected from gasoline, kerosene, diesel fuel, or jet fuel.

3. The composition of claim 1 or 2, wherein said polymer is an ionic-association polymer consisting essentially of an acidic copolymer consisting essentially of the polymerization reaction product of styrene with up to four weight percent of acrylic acid and a basic copolymer consisting essentially of the reaction product of dimethylamine with the polymerization reaction product of styrene with up to four weight percent of vinyl benzyl chloride.

4. The composition of claim 1 or 2, wherein said polymer is a coordination-complex polymer consisting essentially of the reaction product of imino-diacetic acid and the polymerization reaction of styrene and vinyl benzyl chloride complexed with a divalent metal selected from copper, cobalt, chromium, or nickel.

5. A process for improving the elongational viscosity of hydrocarbon fluids subjected to a high shear comprising adding to said hydrocarbon fluids an ionic-association or coordination-complex polymer in an amount effective to increase the elongational viscosity of said hydrocarbon; said polymer capable of dissociation upon application of the high shear regime to which said hydrocarbon is subjected, and reassociation upon withdrawal of the high shear.

6. The process of claim 5, wherein said polymer is added in an amount up to about 5% by weight.

7. The process of claim 5 or 6, wherein said polymer is an ionic-association polymer consisting essentially of an acidic copolymer consisting essentially of the polymerization reaction product of styrene with up to four weight percent of acrylic acid and a basic copolymer consisting essentially of the reaction product of dimethylamine with the polymerization reaction product of styrene with up to four weight percent of vinyl benzyl chloride.

8. The process of claim 5 or 6, wherein said polymer is a coordination-complex polymer consisting essentially of the reaction product of iminodiacetic acid and the polymerization reaction of styrene and vinyl benzyl chloride complexed with a divalent metal selected from copper, cobalt, chromium, or nickel.

* * * * *